US008734060B1

(12) United States Patent
Wauhop

(10) Patent No.: US 8,734,060 B1
(45) Date of Patent: May 27, 2014

(54) DOUBLE-WALL STRUCTURE COMPRISED OF INTERCONNECTED DRY-STACKED WALL BLOCKS

(75) Inventor: Billy J. Wauhop, Belvidere, NJ (US)

(73) Assignee: E. Dillon & Company, Swords Creek, VA (US)

( * ) Notice: Subject to any disclaimer, the term of this patent is extended or adjusted under 35 U.S.C. 154(b) by 120 days.

(21) Appl. No.: 12/932,123

(22) Filed: Feb. 17, 2011

(51) Int. Cl.
*E02D 29/02* (2006.01)

(52) U.S. Cl.
USPC ..... 405/286; 405/284

(58) Field of Classification Search
USPC ..... 405/284, 286
See application file for complete search history.

(56) References Cited

U.S. PATENT DOCUMENTS

| | | | | |
|---|---|---|---|---|
| D184,747 | S | 3/1959 | Livesay | |
| 4,860,505 | A | 8/1989 | Bender | |
| 5,064,313 | A | 11/1991 | Risi et al. | |
| 5,161,918 | A | 11/1992 | Hodel | |
| 5,257,880 | A | 11/1993 | Janopaul, Jr. | |
| D343,461 | S | 1/1994 | Powell | |
| D347,070 | S | 5/1994 | Anderson et al. | |
| 5,337,527 | A | 8/1994 | Wagenaar | |
| 5,457,926 | A | 10/1995 | Jensen | |
| 5,484,236 | A | 1/1996 | Gravier | |
| 5,505,034 | A | 4/1996 | Dueck | |
| 5,622,456 | A | 4/1997 | Risi et al. | |
| 5,678,958 | A | 10/1997 | Rossi | |
| 5,711,129 | A | 1/1998 | Woolford | |
| 5,791,827 | A * | 8/1998 | Arvai et al. | 405/286 |
| 5,795,105 | A * | 8/1998 | Guth | 405/284 |
| 5,800,097 | A | 9/1998 | Martin | |
| 5,941,042 | A | 8/1999 | Dueck | |
| 5,951,210 | A | 9/1999 | Maguire et al. | |
| 6,019,550 | A | 2/2000 | Wrigley et al. | |
| 6,082,933 | A | 7/2000 | Maguire et al. | |
| 6,168,353 | B1 * | 1/2001 | Price | 405/284 |
| D445,512 | S | 7/2001 | Sievert | |
| D459,487 | S | 6/2002 | Bott | |
| D464,149 | S | 10/2002 | Risi et al. | |
| D466,229 | S | 11/2002 | Risi et al. | |
| D467,009 | S | 12/2002 | Agee | |
| 6,490,837 | B1 | 12/2002 | Dueck et al. | |
| 6,523,317 | B1 | 2/2003 | Bott et al. | |
| D475,143 | S | 5/2003 | Hammer | |
| D485,371 | S | 1/2004 | Burgess et al. | |
| 6,692,195 | B2 * | 2/2004 | Jansson | 405/286 |
| 6,796,098 | B2 | 9/2004 | Hampton | |
| 6,821,058 | B1 | 11/2004 | Dawson | |
| 6,829,867 | B2 | 12/2004 | Gresser et al. | |
| D501,935 | S | 2/2005 | Dawson et al. | |
| 6,854,220 | B2 | 2/2005 | Dueck et al. | |
| 6,874,293 | B2 | 4/2005 | Manthei | |
| 7,059,808 | B2 | 6/2006 | Risi | |

(Continued)

*Primary Examiner* — Benjamin Fiorello
(74) *Attorney, Agent, or Firm* — Adams & Wilks

(57) ABSTRACT

A double-wall structure, such as a fence wall or a parapet wall, has two back-to-back walls each constructed of successive courses of concrete wall blocks dry-stacked one atop another with each succeeding course set back relative to the immediately preceding course so that the two walls converge upwardly towards one another and are capped at the top by cap blocks. Each wall block has protuberances that protrude upwardly from the top face of the block and a groove provided in the bottom face thereof. The groove is located and dimensioned relative to the protuberances so that the grooves of wall blocks in each succeeding course engage with the protuberances of wall blocks in the immediately preceding course to establish the setback distance between abutting courses of wall blocks.

25 Claims, 8 Drawing Sheets

(56) References Cited

U.S. PATENT DOCUMENTS

| | | | | |
|---|---|---|---|---|
| D530,832 | S | 10/2006 | Rainey | |
| D539,436 | S | 3/2007 | Magliocco et al. | |
| 7,396,190 | B2 | 7/2008 | Price | |
| 7,448,830 | B2 * | 11/2008 | MacDonald et al. | 405/284 |
| D587,382 | S | 2/2009 | Wauhop | |
| 7,497,646 | B2 | 3/2009 | Price | |
| 2003/0127581 | A1 | 7/2003 | Manthei et al. | |
| 2003/0160147 | A1 | 8/2003 | Manthei | |
| 2005/0274085 | A1 | 12/2005 | Risi | |
| 2007/0274786 | A1 * | 11/2007 | Scandaliato | 405/107 |
| 2008/0085162 | A1 | 4/2008 | Blundell | |

* cited by examiner

DOUBLE-WALL STRUCTURE COMPRISED OF INTERCONNECTED DRY-STACKED WALL BLOCKS

BACKGROUND OF THE INVENTION

1. Field of the Invention

The present invention relates generally to walls constructed of blocks and, more particularly, to double-wall structures of dry-stacked blocks.

2. Background Information

Walls are used in various construction projects and are available in a wide variety of styles. Numerous methods and materials exist for the construction of walls. Such methods include the use of natural stone, poured concrete, precast panels, masonry, and landscape timbers or railroad ties.

Two known types of common walls are fence walls and parapet walls. Fence walls are typically used as landscape structures for soil retention and for protection of natural and artificial structures. Parapet walls are wall-like barriers at the edge of a roof, terrace, balcony or other structure. For roof, terrace and balcony applications, parapet walls are in the form of low walls that also function as a replacement for hand rails and are provided for various reasons, including safety and aesthetics. In another particular application, parapet walls are used as reinforcement against the accidental impact of vehicular traffic.

In recent years, concrete wall blocks, which are dry stacked (i.e., stacked without the use of mortar), have become widely accepted in the construction of walls. Such wall blocks have gained popularity because they are mass produced and, consequently, relatively inexpensive. They are structurally sound, easy and relatively inexpensive to install, and couple the durability of concrete with the attractiveness of various architectural finishes.

The current use of such wall blocks to build fence and parapet walls has been limited to the use of columns or piers as a method of reinforcing the fence or parapet wall. These columns or piers are routinely placed atop and anchored to a poured, steel-reinforced, concrete foundation that requires a different labor force for construction than the one used to install the wall. The actual fence itself may require a concrete foundation. In the case of fence wall applications, the columns or piers are regularly spaced and used as reinforcement against wind-loading. In the case of parapet wall applications, the columns or piers are placed atop a retaining wall, such as adjacent a parking lot, for use as reinforcement against accidental impact of vehicular traffic.

The conventional structures and methods for constructing fence walls and parapet walls utilizing segmental concrete wall blocks have suffered from various drawbacks, including difficulty in installation and high construction costs. In the case of fence walls, the conventional methods and structures have been unable to achieve sufficient resistance to wind-loading forces. In the case of parapet walls, the conventional methods and structures have been unable to provide an adequate retaining function as a handrail or to resist the forces of accidental vehicular traffic impact.

SUMMARY OF THE INVENTION

An object of the present invention is to provide a double-wall structure which is comprised of interconnected dry-stacked wall blocks.

Another object of the present invention is to provide a double-wall structure of interconnected dry-stacked wall blocks that has sufficient structural integrity for use as a fence wall or a parapet wall.

A further object of the present invention is to provide a double-wall structure of interconnected dry-stacked wall blocks that can easily be erected by a landscaper.

Another object of the present invention is to provide a double-wall structure comprised of interconnected dry-stacked wall blocks erected on a foundation comprised of interconnected dry-stacked base blocks.

A further object of the present invention is to provide a double-wall structure having two back-to-back walls constructed of dry-stacked blocks.

A further object of the present invention is to provide a double-wall structure having two back-to-back walls each comprised of successive courses of wall blocks and in which the wall blocks in each succeeding course are set back relative to the wall blocks in the immediately preceding course so that the two walls converge upwardly towards one another.

Another object of the present invention is to provide a double-wall structure having two back-to-back walls each comprised of successive courses of wall blocks erected on a foundation comprised of one or more courses of base blocks.

Another object of the present invention is to provide a double-wall structure having two back-to-back walls each comprised of successive courses of dry-stacked blocks and in which the blocks in abutting courses are interconnected by a protuberance-and-groove connection.

The foregoing as well as other objects of the present invention are achieved by a double-wall structure having two back-to-back walls each comprising successive courses of wall blocks dry-stacked one atop another with each succeeding course set back relative to the immediately preceding course so that the two back-to-back walls converge upwardly towards one another. Each wall block has an internal cavity, and the internal cavities of the wall blocks in each succeeding course partly overlap the internal cavities of wall blocks in the immediately preceding course. The internal cavities of the wall blocks and the space between the backs of the two walls of wall blocks are filled with a filler such as loose stone.

Each wall block has protuberances that protrude upwardly from the top face thereof and a groove provided in the bottom face thereof. The groove is located and dimensioned relative to the protuberances so that the grooves of the wall blocks in each succeeding course engage with the protuberances of the wall blocks in the immediately preceding course with each succeeding course set back relative to the immediately preceding course.

The double-wall structure is erected on a foundation comprised of one or more courses of base blocks beneath each wall of wall blocks. Each base block has protuberances protruding upwardly from the top face thereof and a groove provided in the bottom face thereof. The groove is located and dimensioned relative to the protuberances so that the grooves of the base blocks in each succeeding course engage with the protuberances of the base blocks in the immediately preceding course with each succeeding course set back relative to the immediately preceding course. The setback distance between abutting courses of base blocks is the same as the setback distance between abutting courses of wall blocks.

Additional objects, advantages and features of the disclosure will be set forth in part in the description which follows, and in part will become apparent to those skilled in the art upon examination of the following description or may be learned by practice of the disclosure.

DETAILED DESCRIPTION OF THE INVENTION

Figure 1:
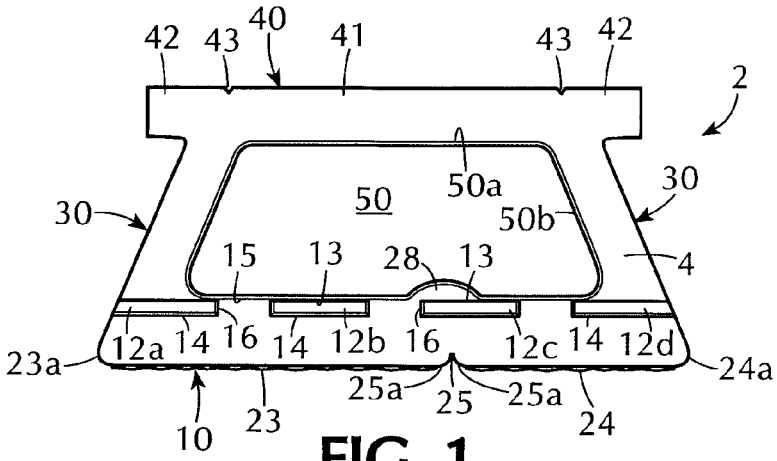
FIG. 1 is a top view of one embodiment of a wall block that may be used to erect a double-wall structure according to the present invention.
Figure 2:
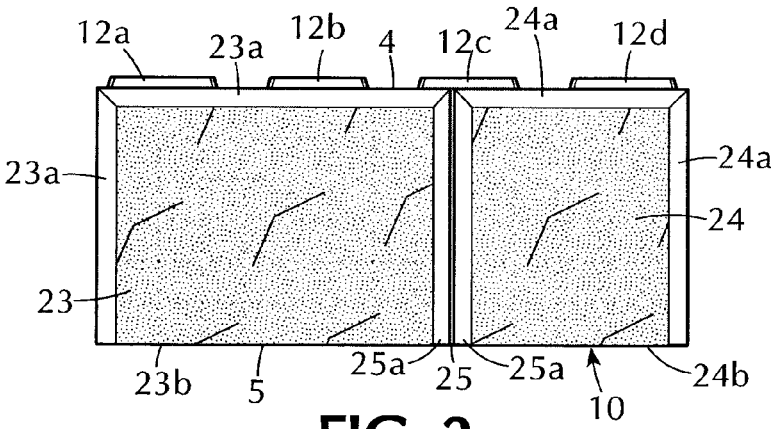
FIG. 2 is a front view of the wall block.
Figure 3:
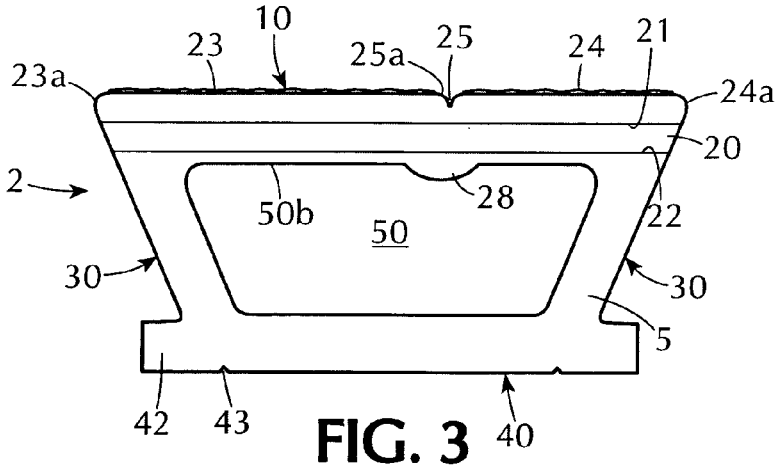
FIG. 3 is a bottom view of the wall block.

The figures of the drawings are simplified for illustrative purposes and are not necessarily drawn to scale. To facilitate understanding, the same reference numerals have been used, where possible, to designate the same elements or parts that are common to the figures, and suffixes may be added, where appropriate, to differentiate elements or parts that are similar but different.

The drawings illustrate examples or embodiments of the present invention and, as such, should not be considered as limiting the scope of the invention. It is contemplated that features of one example or embodiment may be incorporated in other examples or embodiments without further recitation. Any example or embodiment described herein as "exemplary" or "alternative" is not necessarily to be construed as preferred or advantageous over other examples or embodiments.

As used herein, the term "wall" means a wall or a wall section regardless of its length or height.

As used herein, the term "dry-stacked" means, with reference to stacking blocks, that the blocks are stacked one atop another without use of mortar in the joints between abutting blocks in the same course or in adjoining courses.

Figure 11:
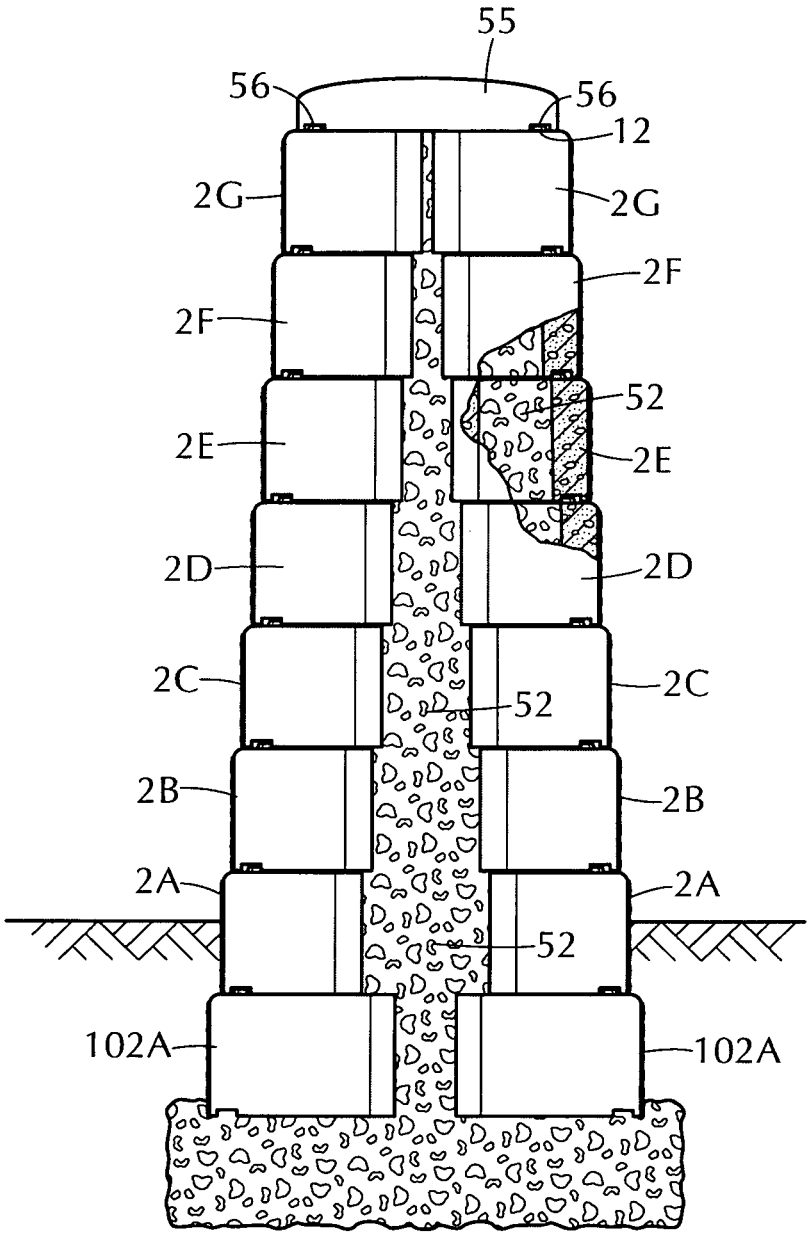
FIG. 11 is an explanatory end view, partly in section, illustrating an embodiment of a double-wall structure constructed of wall blocks erected on a foundation of base blocks according to the present invention.
Figure 12:
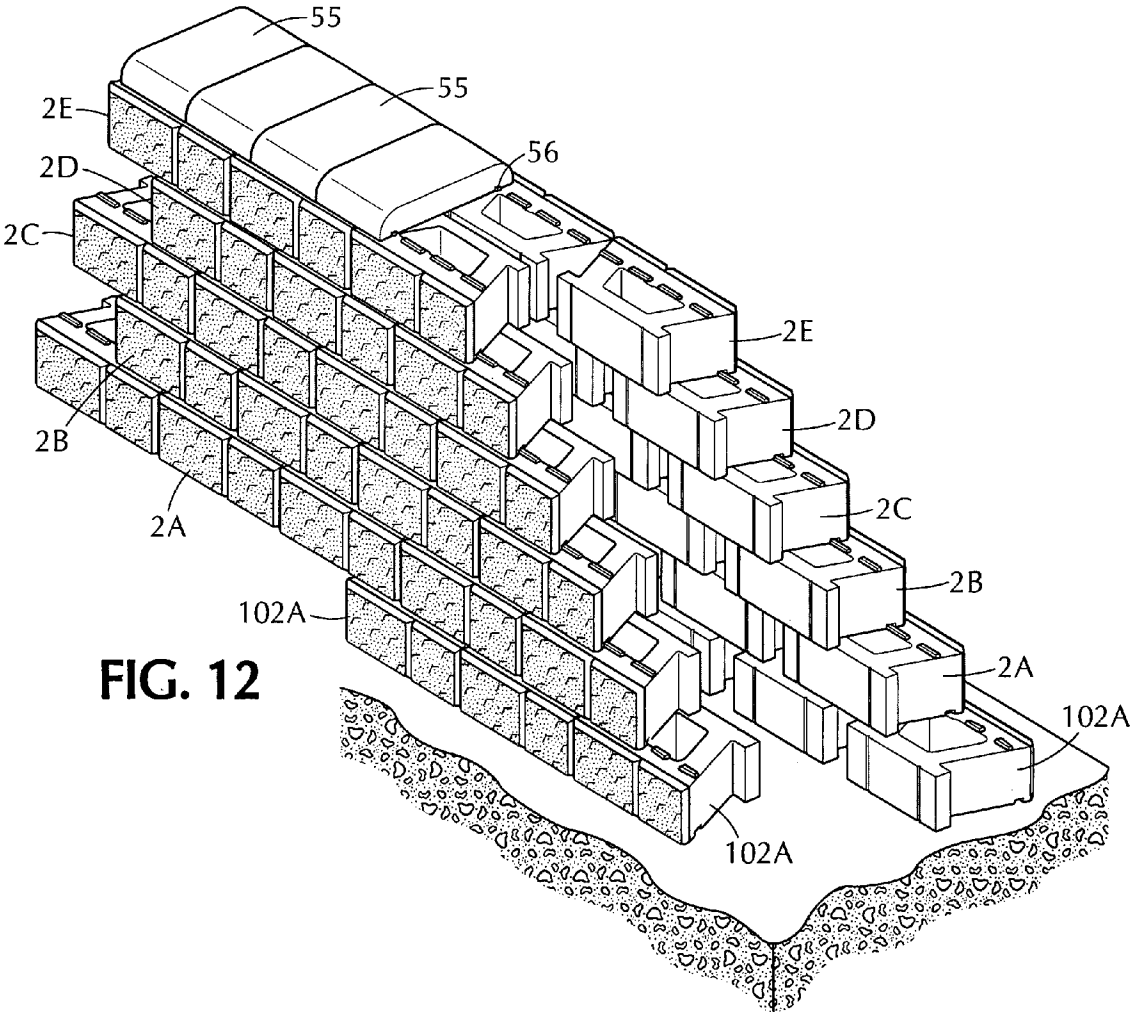
FIG. 12 is an explanatory perspective view of another embodiment of a double-wall structure constructed of wall blocks erected on a foundation of base blocks according to the present invention.
Figure 13:
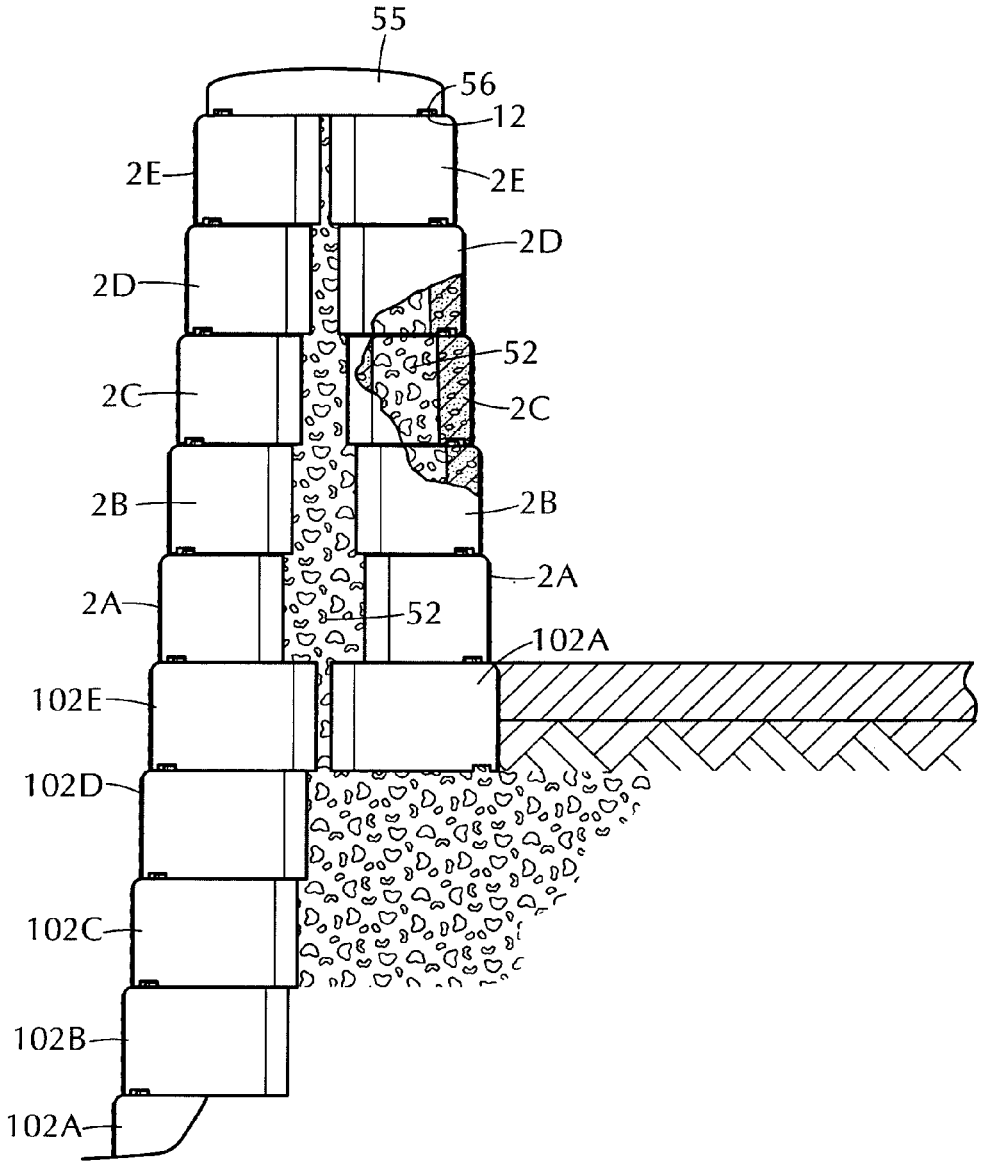
FIG. 13 is an explanatory end view, partly in section, of another example of a double-wall structure constructed of wall blocks erected on a foundation of base blocks according to the present invention.
Figure 14:
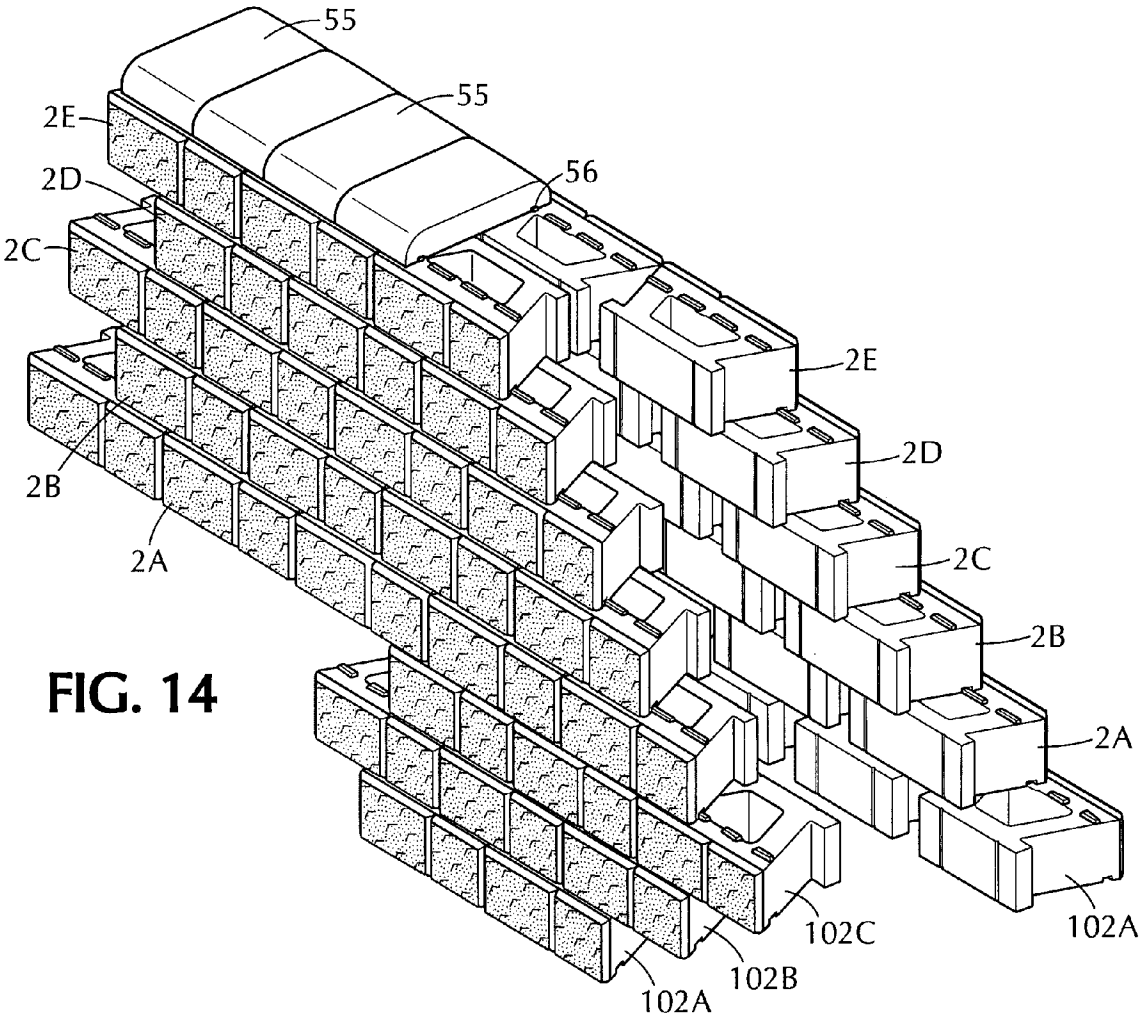
FIG. 14 is an explanatory perspective view of another example of a double-wall structure constructed of wall blocks erected on a foundation of base blocks according to the present invention.

The double-wall structure according to the present invention has numerous uses and applications, some of which are illustrated in the drawings and described herein. Other uses and applications will be readily apparent to those skilled in the art. FIGS. 11 and 12 illustrate examples of a double-wall structure erected as a fence wall, and FIGS. 13-14 illustrate examples of a double-wall structure erected as a parapet wall atop a retaining wall. In each case, the double-wall structure has two back-to-back walls each comprised of successive courses of wall blocks dry-stacked one atop another with each succeeding course set back with respect to the immediately preceding course so that the two back-to-back walls converge upwardly towards one another. The wall blocks have protuberances on their upper face and a groove on their lower face and when the wall blocks are dry-stacked one atop another, the protuberances of a lower course of blocks engage with the grooves of an upper course of blocks so that the wall blocks in adjoining courses are interconnected together without the use of mortar or other bonding agents.

The double-wall structure is preferably erected on a foundation, and the foundation may comprise one or more courses of base blocks beneath each wall of wall blocks. The base blocks have a greater depth than the wall blocks and provide a supporting base for the double-wall structure. The base blocks, like the wall blocks, have protuberances on their top face and a groove on their bottom face to interconnect successive courses of base blocks to one another as well as to interconnect the uppermost course of base blocks to the lowermost course of wall blocks without the use of mortar or other bonding agents.

Before describing double-wall structures according to the present invention, a description will be given of one type of wall block that may be used to construct the double-wall structure and one type of base block that may be used to construct a foundation on which the double-wall structure is erected.

Referring to the drawings, FIGS. 1-5 illustrate one example of a wall block 2 that may be used in practicing the present invention. The wall block 2 is a molded concrete structure, as described more fully hereinafter, comprised of a front section 10, two side sections 30, 30 and a rear section 40. The front section 10 and the rear section 40 are spaced apart from one another and interconnected by the side sections 30, 30. The two side sections 30, 30 are laterally spaced apart in the lateral or sideways direction of the block 2 and converge in a direction from the front section 10 to the rear section 40 so that the wall block 2 has a trapezoidal shape.

The interconnected front, side and rear sections define a center through-cavity (internal cavity) 50 that extends completely through the wall block 2 from the top face 4 of the block to the bottom face 5. The cavity 50 has a slight inward taper, generally on the order of 1°-1½°, in the top-bottom direction, as seen in FIG. 1, so that the cavity opening 50*a* at the top of the block 2 is larger than the cavity opening 50*b* at the bottom of the block. This taper facilitates removal of the blocks from the mold during manufacture. The through-cavity 50 is provided to greatly reduce the block weight and thus facilitate transportation, handling and installation of the wall blocks 2 as well as to reduce the quantity of concrete and other constituents thereby lowering the cost of manufacture of the blocks.

The rear section 40 has a main part 41 and two lateral extension parts 42, 42 that extend outwardly in the lateral or sideways direction from the main part 41. The rear face of the rear section 40 is provided with score grooves 43, 43 that extend from the top face 4 to the bottom face 5. The score grooves 43 are provided to enable removal of one or both of the lateral extension parts 42, such as may be required, for example, when installing a wall having a curvilinear section. The lateral extension parts 42 can be removed by striking them with a hammer so that they break away from the main part 41 and separate from the wall block 2 at the region where the lateral extension parts 42 meet with the side sections 30.

In the following description of the preferred embodiments, exemplary wall blocks are described with reference to particular exemplary dimensions to facilitate understanding of the disclosure. The disclosure is not, of course, limited or restricted to these dimensions, which are provided solely for illustrative purposes. To manufacture blocks of different sizes, these dimensions may be scaled up or down, or other dimensions all together could be used, as would be well understood by persons skilled in the art. In the case of the exemplary embodiment shown in FIGS. 1-5, the wall block 2 has a lateral or side-side dimension of 18 inches, i.e., the maximum widthwise dimension of the front section 10, and a depth or front-rear dimension of 9 inches, i.e., the maximum dimension between the front face of the front section 10 and the rear face of the rear section 40.

In this embodiment, the wall block 2 is provided with protuberances on the top face thereof and a groove on the bottom face thereof so that when successive courses of wall blocks are dry-stacked one atop another with the blocks of each course being staggered relative to the blocks of adjoining courses, the protuberances of a preceding course of blocks will interlock with the grooves of a succeeding course of blocks. The protrusions and grooves are preferably located and dimensioned such that in successive courses of wall blocks, each succeeding course is set back relative to the immediately preceding course.

In the exemplary embodiment shown in FIGS. 1-5, four protuberances 12*a*, 12*b*, 12*c*, 12*d* (collectively protuberances 12) protrude outwardly from the top face 4 of the front section 10 frontward of the through-cavity 50. As used herein, the term "protuberance", unless otherwise qualified, is used in its broadest sense to refer to a protruding part, without limitation as to any particular configuration, including a lug, projection, knob, tab and protrusion. In this exemplary embodiment, the protuberance 12 have a generally rectangular shape though, as noted, may be of other shapes.

Figure 4:
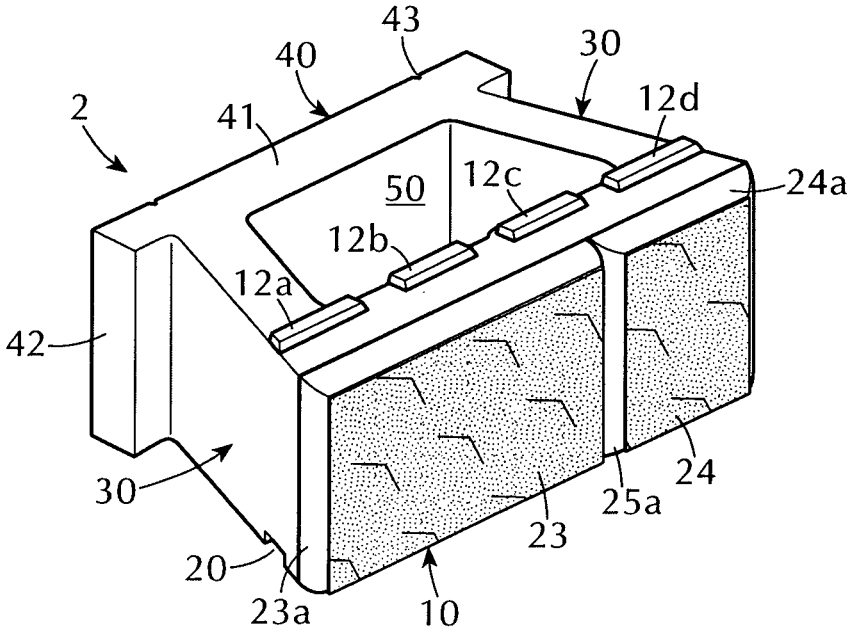
FIG. 4 is a top, front perspective view of the wall block.
Figure 5:
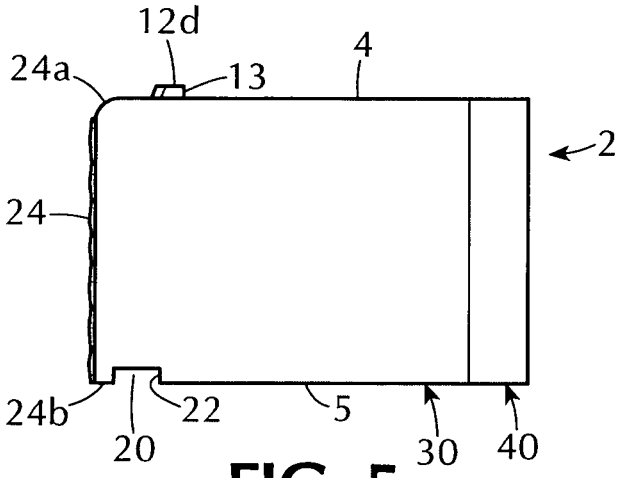
FIG. 5 is a right side view of the wall block.
Figure 6:
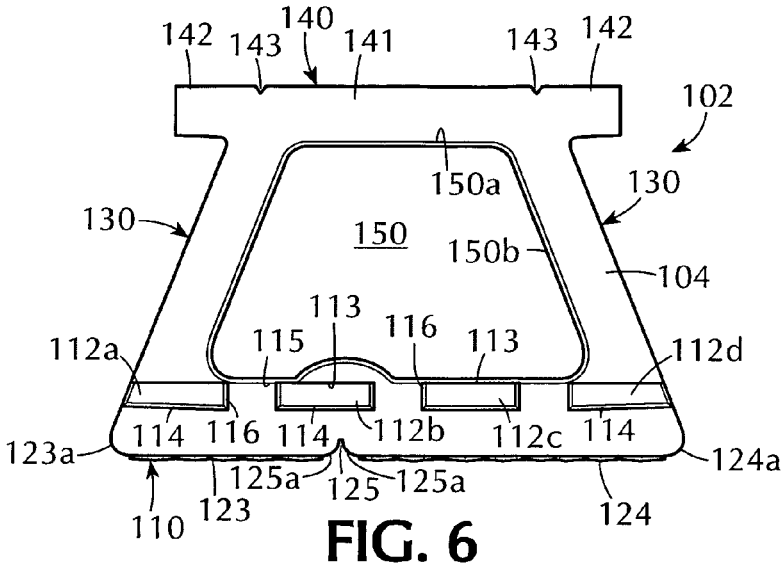
FIG. 6 is a top view of one embodiment of a base block that may be used to erect a foundation for supporting a double-wall structure according to the present invention.
Figure 7:
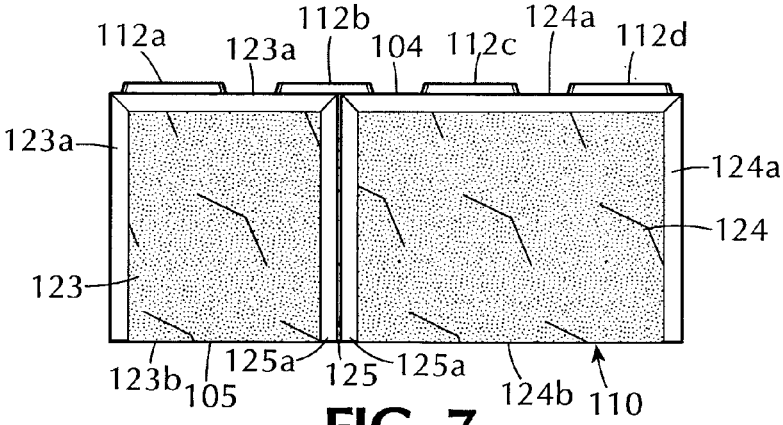
FIG. 7 is a front view of the base block.
Figure 8:
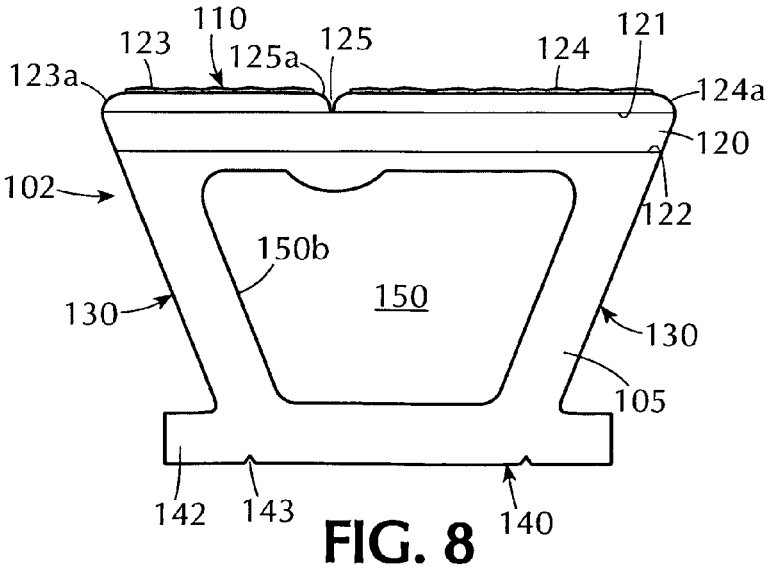
FIG. 8 is a bottom view of the base block.
Figure 9:
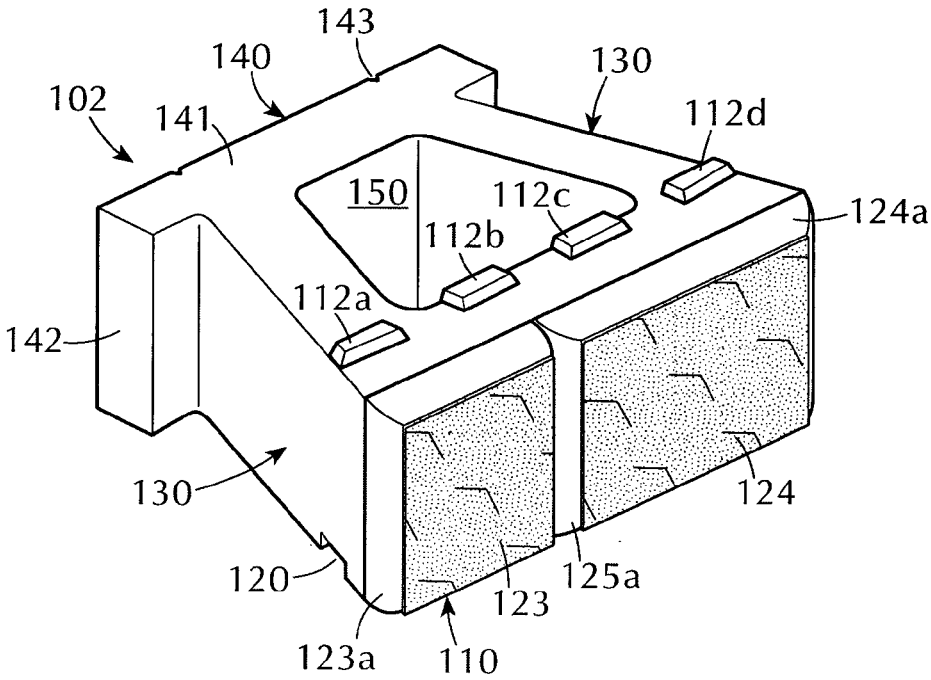
FIG. 9 is a top, front perspective view of the base block.
Figure 10:
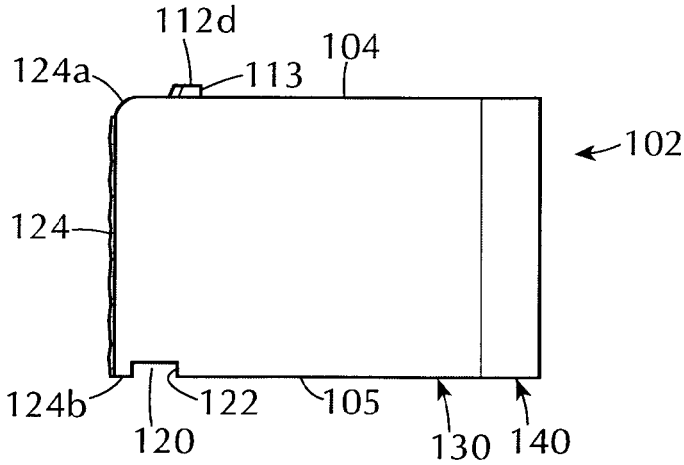
FIG. 10 is a right side view of the base block.

The protuberances 12*a*, 12*b*, 12*c*, 12*d* are laterally spaced apart from one another. As shown in FIGS. 1 and 5, the rear sides 13 of the protuberances 12 are flat and essentially perpendicular (i.e., within 1°-1½°) to the top face 4 of the front section 10. The flat rear sides 13 lie along an imaginary line that is coincident with a rear corner edge 15 of the front section 10. More particularly, the rear corner edge 15 defines the boundary between the top surface 4 and a rear surface of the front section 10, as best seen in FIGS. 1 and 4, and except for a protruding portion 28 (which is described later) at the rear of the front section 10, the flat rear sides 13 of the protuberances 12 otherwise lie along a line coincident with the rear corner edge 15. The flat rear side 13 of the protuberance 12*b* is flush with the rear surface of the front section 10. The two outer protuberances 12*a* and 12*d* are positioned frontwardly of the front ends of the side sections 30 and 30, and the protuberance 12*c* is positioned in the region of the protruding portion 28.

The protuberances 12 in this exemplary embodiment have a generally rectangular shape with rear sides 13, front sides 14 and opposed lateral sides 16, 16. The two inner protuberances 12*b*, 12*c* have a uniform rectangular shape, and the two outer protuberances 12*a*, 12*d* have a generally rectangular shape with the outer ends thereof being angled in the widthwise direction to match the contour of the block. In the case of the exemplary block having the dimensions described above, the rectangularly-shaped protuberances 12 have a uniform width dimension of about inch. As used herein, the term "about" means the specified dimensions as well as values within a range of ±1/16 inch of the specified dimensions. The front sides 14 and the two opposed lateral sides 16, 16 of the protuberances 12 are likewise flat though slightly inclined, for example, at an angle of 5°, from the normal so that the protuberances 12 are slightly tapered in the thickness direction, which aids in the release of the mold head or top plunger with shoes from the surfaces of the newly formed concrete protuberances. The inclination of the sides is greatly exaggerated in the drawings for illustrative purposes.

The bottom face 5 of the front section 10 is provided with a groove 20 that extends laterally or sideways through-out the width of the front section 10 frontward of the through-cavity 50. As used herein, the term "groove", unless otherwise qualified, is used in its broadest sense to refer to an elongate hollowed-out region, without limitation as to any particular configuration, including a channel, passage, slot and recess. The groove 20 has a front wall 21 and a rear wall 22, which are spaced apart from one another in the front-rear direction of the wall block 2. In this exemplary embodiment, the front and rear walls 21 and 22 are perpendicular to the bottom face 5, though perpendicularity is not required. The width of the groove 20, i.e., the distance between the front wall 21 and the rear wall 22, is significantly greater than the width of the protuberances 12. For example, if the protuberances 12 have a maximum widthwise dimension of about ½ inch, the groove 20 would have a widthwise dimension of about ½ inch. This ensures that the protuberances 12 of an underlying block fit loosely in the groove 20 of an overlying block thereby facilitating stacking of the wall blocks 2 one atop another and permitting forward/rearward adjustment of an upper block relative to a lower block. In addition, the clearance between the protuberances 12 of one block and the groove walls 21 and 22 of another block permits variation of the setback amount as well as allowing for slight curvatures in the erected wall.

In accordance with another aspect of the disclosure, the front face of the front section 10 of the wall block 2 is textured and provided with a split panel that divides the front face into two textured panels of different widths. As shown in FIGS. 1-4, the front surface of the front section 10 is divided into two panels 23 and 24 of different widths by a groove 25 that extends in the top-bottom direction which, in this exemplary embodiment, is the vertical direction. The depth of the groove 25 may be slightly greater at the top face 4 than at the bottom face 5. The groove 25 constitutes a manufactured dress joint that exhibits the same appearance between the panels 23 and 24 as exhibited by the actual joints between the panels of laterally adjacent wall blocks as illustrated in FIGS. 12 and 14. Stated otherwise, the curve-edged groove 25 constitutes a simulated joint that simulates the actual joints between adjacent panels of laterally abutting wall blocks in an erected wall.

To preserve the structural integrity of the wall block 2 due to the presence of the groove 25, the rear side of the front section 10 has a protruding portion 28 in the region directly behind the groove 25. The protruding portion 28 protrudes into the through-cavity 50 and, like the groove 25, extends in the top-bottom direction from the top surface 4 to the bottom surface 5 of the front section 10.

As illustrated in FIGS. 1-5, the panel 23 terminates at its top and outer side in curved edges 23*a*. Similarly, the panel 24 terminates at its top and outer side in curved edges 24*a*. The groove 25 likewise has opposed curved edges 25*a*. All of the curved edges 23*a*, 24*a*, 25*a* are rounded and have the same size, shape and curvature and preferably have a smooth, gentle curvature that creates an aesthetically pleasing appearance. Another advantage of the rounded edges 23*a*, 24*a*, 25*a* is that they resist chipping, which is a common problem with sharp edges during manufacturing, inventorying, shipping and installation. The bottom edge 23*b* of the panel 23 and the bottom edge 24*b* of the panel 24 are flat and have no curvature.

An exemplary type of base block 102 for use in erecting a foundation for supporting the double-wall structure is illustrated in FIGS. 6-10. The base block 102 is generally similar to the wall block 2 and the reference numerals used to describe the base block 102 are the same as those used to describe the wall block except that each reference numeral is increased by 100. The base block 102 has the same construction as the retaining wall block described in U.S. patent application Ser. No. 11/900,434, which is hereby incorporated by reference in its entirety. To avoid duplicative description, only the portions or features of the base block 102 that differ from the wall block 2 will be described.

In the exemplary embodiment illustrated in FIGS. 1-5, the wall block 2 has a lateral or side-side dimension of 18 inches, which is the maximum widthwise dimension of the front section 10, and a depth or front-rear dimension of 9 inches, which is the maximum depth dimension between the front face of the front section 10 and the rear face of the rear section 40. A base block 102 that would be compatible with the wall block 2 has a lateral or side-side dimension of 18 inches, similar to that of the wall block, and a depth or front-rear dimension of 12 inches, which is greater than that of the wall block. In the case of the wall block 2, the lateral or side-side dimension of the rear section 40 is 15 inches, whereas the lateral or side-side dimension of the base block 102 is 13½ inches. Both the wall block 2 and the base block 102 have a height dimension, i.e., the distance between the top and bottom faces, of 8 inches. Thus the base block 102 has a greater depth than that of the wall block 2, whereas the wall block 2 has a wider through-cavity (internal cavity) than that of the base block 102. The relative dimensions of the two blocks can be appreciated by comparing the wall block 2 illustrated in FIG. 4 with the base block 102 illustrated in FIG. 9.

The protuberances 112 of the base block 102 have a generally rectangular shape with rear sides 113, front sides 114 and opposed lateral sides 116,116. The two inner protuberances 112*b*,112*c* have a uniform rectangular shape, and the two outer protuberances 112*a*,112*d* have a generally rectangular but slightly tapered shape with the outer ends thereof being narrower in the width direction than the inner ends thereof. In the case of the exemplary block 102 having the dimensions described above, the rectangularly-shaped protuberances 112 have a uniform width dimension of about ¾ inch. The generally rectangularly-shaped protuberances 112*a*,112*d* have a width dimension of about ½ inch at the outer ends and a width dimension of about ¾ inch at the inner ends so that the protuberances 112*a*,112*d* are slightly tapered in the lengthwise direction thereof with the outer ends being of smaller width than the inner ends. The reason for this slight taper of the two outer protuberances 112*a*,112*d* is to aid in the construction of a slightly curved wall without having the front sides 114 of the protuberances 112*a* and 112*d* engaged with the front walls 121 of the grooves 120.

In this embodiment of the base block, the protuberances 112 have a maximum widthwise dimension of about ¾ inch, and the groove 20 has a widthwise dimension of about 1 inch. This ensures that the protuberances 112 of an underlying base block fit loosely in the groove 120 of an overlying base block thereby facilitating stacking of the base blocks one atop another and permitting forward/rearward adjustment of an upper block relative to a lower block. In addition, the clearance between the protuberances 112 of one block and the groove walls 121 and 122 of another block permits variation of the setback amount as well as allowing for slight curvatures in the erected wall.

The front section 110 of the base block 102 is divided into two panels 123 and 124 of different widths by a groove 125 that extends in the top-bottom direction. The depth of the groove 125 is slightly greater at the top face 104 than at the bottom face 105. As illustrated in FIGS. 6-10, the panel 123 terminates at its top and outer side in curved edges 123*a*, and the panel 124 terminates at its top and outer side in curved edges 124*a*. The groove 125 likewise has opposed curved edges 125*a*. All of the curved edges 123*a*,124*a*,125*a* are rounded and have the same size, shape and curvature as that of the curved edges 23*a*,24*a*,25*a* of the panels 23 and 24 of the wall block 2. This allows the base blocks 102 to be dry-stacked one atop another in staggered relation to form a foundation on which the wall blocks can be dry-stacked one atop another in staggered relation to form a wall, wherein the vertical and horizontal joints of the base blocks and wall blocks all exhibit the same appearance.

The wall blocks 2 and the base blocks 102 may be molded from dry cast, low slump masonry concrete by, for example, the process described in the aforementioned U.S. patent application Ser. No. 11/900,434, which is incorporated herein by reference. The blocks, both the wall blocks and the base blocks, are molded as two-block units so that two blocks are formed in face-to-face contact by a single casting process. The molded block unit is split along a common interface or split line to obtain two individual blocks. The grooves are formed in the bottom faces of the blocks by milling or grinding, preferably prior to splitting of the block unit. The splitting of the block unit along the interface provides each block with a textured, decorative front surface. The two split blocks are mirror images of one another so that if the two blocks were stacked one atop another, the simulated joint between the two panels of one block would not be vertically aligned with the simulated joint between the two panels of the other block. By selecting one or the other of the two blocks during installation of a wall, the likelihood of having two repeating vertical joints in two adjacent courses is greatly diminished.

In erecting a double-wall structure using the wall blocks 2, it is preferable to lay the first course of wall blocks of each wall, then lay the second course of wall blocks, then the third, etc. The desired height of the double-wall structure will determine the number of courses and the back-to-back spacing between the bottommost courses of wall blocks of the two walls. In the double-wall structures illustrated in FIGS. 11-14, the wall blocks 2A in the first course of each wall are laid in side-by-side abutting relation with the back faces of the blocks in one course spaced a predetermined distance from the back faces of the blocks in the other course. After the two back-to-back courses of wall blocks 2A are laid, filler 52, such as loose stone, is filled in the space between the back-to-back blocks and also filled in the internal cavities 50 of the blocks 2A. Next, the wall blocks 2B in the second courses of both walls are laid in the same way but offset or laterally staggered so that each upper block 2B overlaps two adjacent blocks 2A in the immediately preceding course. When installing an upper block 2B on two adjacent lower blocks 2A, the groove 20 of the upper block 2B is loosely fitted over protuberances 12 of the two lower blocks 2A, and then the upper block 2B is pushed forwardly so that the flat rear sides 13 of the protuberances 12 engage with the rear wall 22 of the groove 20 (see FIGS. 11 and 13). In this manner, each upper block 2B is interlocked with two adjacent lower blocks 2A, and the upper blocks 2B are set back relative to the lower blocks 2A. The setback distance is chosen to fully expose the upper curved edges of the lower blocks 2A so that, as shown in FIGS. 12 and 14, the vertical and horizontal joints of all the wall blocks have the same appearance. Successive courses of wall blocks 2C, 2D, etc. are laid in a similar manner for each wall to erect a double-wall structure in which, in each wall, each succeeding course is set back from its preceding course. The required setback is predetermined and automatically established due to the dimensions and locations of the protuberances 12 and the grooves 20.

By such a construction, vertically abutting wall blocks 2 in adjoining courses are interlocked to one another by engagement of the rear sides 13 of the protuberances 12 with the rear walls 21 of the grooves 20, and a clearance space exists between the front sides 14 of the protuberances 12 and the front walls 22 of the grooves 20. The clearance between the protuberances and the groove walls allow for slight shifting or displacement of the blocks relative to one another during installation due, for example, to manufacturing tolerances.

In an alternative embodiment, the width of the grooves 20 could be made wider in width to provide a correspondingly deeper setback. However, such an alternative construction would diminish the uniformity of the joints between all of the blocks and detract from the aesthetically attractive appearance created when all of the joints are the same.

As illustrated in FIGS. 11-14, the two back-to-back walls each comprise successive courses of wall blocks 2 dry-stacked one atop another with each succeeding course set back relative to the immediately preceding course so that the two back-to-back walls converge or slant upwardly towards one another. The void or space between the backs of the opposed walls is filled with loose stone or other filler 52, and the internal cavities 50 inside the wall blocks 2 are likewise filled with loose stone or other filler 52 to assist in locking the erected wall blocks together structurally. For the wall block dimensions described above, ¾ inch stone fill is preferred. The tops of the wall blocks in both walls are capped by cap blocks 55 to prevent ingress of water into the void between the two walls and to provide an aesthetic appearance to the double-wall structure. The cap blocks 55 extend over the tops of the wall blocks in the uppermost courses of both walls and have grooves 56 that engage with the protuberances 12 that protrude upwardly from the top faces of the uppermost wall blocks 2. If desired, the caps may be set in mortar to prevent their removal and enhance watertightness between the cap and wall blocks.

The double-wall structure is preferably erected on a foundation that has sufficient strength to support the double-wall structure and that provides a level surface on which to install the wall blocks. In the FIG. 11 embodiment, a man-made foundation is prepared by excavating a trench in the ground and forming a bed of crushed stone in the bottom of the trench. Two spaced-apart courses of base blocks 102A are laid on the bed of crushed stone to form a foundation. A first course of wall blocks 2A is dry-stacked atop each course of base blocks 102A with the wall blocks 2A set back from the base blocks 102A. A second course of wall blocks 2B is dry-stacked atop each course of wall blocks 2A with the blocks 2B set back from the blocks 2A. Successive courses of wall blocks are dry-stacked on preceding courses in the same manner to obtain two back-to-back walls each comprised of successive courses of wall blocks dry-stacked one atop another with each succeeding course set back with respect to the immediately preceding course owing to the protuberance-and-groove connection between the wall blocks in abutting courses so that the two walls converge upwardly towards one another. During installation of the courses of wall blocks, filler 52, such as loose stone or the like, is filled in the space between the backs of the opposed wall blocks and in the internal cavities 50 of the wall blocks as well as in the internal cavities 150 of the base blocks to lock the blocks together structurally. The two uppermost courses of wall blocks 2G in each wall are capped with cap blocks 55. The cap blocks 55 have grooves 56 that engage with the protuberances 12 on the top faces of the wall blocks 2G. To enhance watertightness and prevent unintended removal of the cap blocks 55, the cap blocks may be set in mortar to bond them to the wall blocks 2G.

In this embodiment, each wall of the double-wall structure is erected on a single course of base blocks 102A. If needed or desired, the foundation for one or both walls of the double-wall structure may have two or more courses of base blocks 102 with each succeeding course set back relative to the immediately preceding course owing to the protuberance-and-groove connection between the base blocks in abutting courses. In this embodiment, the double-wall structure constitutes a fence wall which has two opposed decorative faces consisting of the textured front surfaces of the wall blocks.

In the embodiment illustrated in FIG. 12, the double-wall structure comprises a fence wall having two back-to-back walls each comprised of five courses of wall blocks 2A,2B, 2C,2D,2E erected atop a course of base blocks 102A. In this embodiment, the base blocks 102A are situated at ground level and constitute the bottom course of blocks of the fence wall. The base blocks 102A are laid in two courses on a crushed stone base, and the two courses are suitably spaced apart so that the two uppermost courses of wall blocks 2E of the two walls are properly spaced apart to receive the cap blocks 55. Each successive course of blocks in each wall is set back relative to the immediately preceding course so that the two back-to-back walls converge or slant upwardly towards one another and are capped by the cap blocks 55. The course of wall blocks 2A in each wall is set back from its underlying course of base blocks 102A, and the setback distance between the blocks 2A and the blocks 102A is the same as the setback distance between successive courses of wall blocks.

During installation, the base blocks 102A in each course are laid in side-by-side abutting relation, and the wall blocks 2A in the succeeding course are laid in the same way but offset or laterally staggered so that each wall block 2A overlaps two adjacent base blocks 102A. In a similar manner, each of the wall blocks 2B,2C,2D,2E in successive courses are laid in the same way and offset or laterally staggered so that in each successive course, each wall block overlaps two adjacent wall blocks in the immediately preceding course. Though not illustrated, the internal cavities of the blocks and the space between the backs of the two walls of blocks are filled with filler, such as crushed stone, to lock the blocks together structurally. Due to the offset between the protuberances 12 and the grooves 20, in each of the two walls the wall blocks in each successive course are set back relative to the wall blocks in the immediately preceding course. The setback distance is preselected to fully expose the upper curved edges 23*a*, 24*a* of the blocks so that, as shown in FIG. 12, the vertical and horizontal joints of all the blocks have the same appearance. The required setback is predetermined and automatically established due to the dimensions and locations of the protuberances 12 and the grooves 20. The same description applies to the base blocks 102A, and the wall blocks 2A are set back relative to the underlying base blocks 102A by the same setback distance as exists between successive courses of wall blocks.

Due to the flat bottom edges 23*b* and 24*b* of the panels 23 and 24, all the panels of all the wall blocks are bordered by the curved, rounded edges 23*a*, 24*a*, 25*a*, which presents an aesthetically pleasing and attractive appearance. The simulated dress joints created by the curved edges 25*a* of the grooves 25 are virtually indistinguishable from the actual joints between adjacent blocks to an observer. The use of the split-panel technique in this manner results in a double-wall structure having wall faces in which the vertical joints appear to be more random than would otherwise be the case. Consequently, during installation of the double-wall structure, the likelihood of having two repeating vertical joints in two adjacent courses is greatly diminished thereby obviating the need of the installer having to slow down the installation to cut blocks to eliminate vertical alignment of joints.

In an alternative embodiment, the outer side edges 23*a*, 24*a* and/or the groove edges 25*a* of the panels 23, 24 may have shapes other than as illustrated and may be inclined or angled relative to the top and bottom faces 4 and 5 of the retaining wall block. This provides a wide degree of designed freedom in creating textured panels having different decorative or ornamental patterns.

In accordance with a further aspect of the disclosure, the width of the panels 23 and 24 may be freely selected. To minimize the likelihood of having repeated or aligned vertical joints in two adjoining courses of wall blocks, the width of one panel should preferably, but not necessarily, be 1.2 to 3 times greater than the width of the other panel. If the panel width ratio is made less than 1.2, the two panels become too similar in size thereby increasing the probability of having vertically aligned joints in adjacent courses. Similarly, if the panel width ratio were made greater than 3, there would be an increased probability of having vertically aligned joints in adjacent courses.

FIGS. 13 and 14 illustrate a double-wall structure in the form of a parapet wall erected atop a retaining wall. In FIG. 13, multiple courses of base blocks 102A,102B,102C,102D, 102E are dry-stacked one atop another with each succeeding course set back relative to the immediately preceding course to form a foundation on which one of the walls of the double-wall structure is erected. The other wall of the double-wall structure is erected on a foundation comprised of a single course of base blocks 102A that is spaced from the course of base blocks 102E. Wall blocks 2A,2B,2C,2D,2E are dry-stacked in successive courses one atop another with the lower course of wall blocks 2A erected atop the course of base blocks 102E to form one wall, and wall blocks 2A,2B,2C,2D, 2E are dry-stacked one atop another to form the other wall with the lowermost course of wall blocks 2A erected on the course of base blocks 102A. During erection of the retaining wall and the parapet wall, a filler 52 in the form of loose stone is filled in the internal cavities of the blocks and in the space between the backs of the two walls. The tops of the two uppermost courses of wall blocks 2E are capped with cap blocks 55, and the cap blocks 55 may, if desired, be set in mortar or otherwise bonded to the top faces of the courses of wall blocks 2E. In each wall, the blocks in successive courses are interconnected by the protuberance-and-groove connection which, in conjunction with the filler that is filled in the internal cavities of the blocks and filled in the space between the backs of the two walls of blocks, prevents displacement of the blocks relative to one another.

In this example, the parapet wall is installed at the periphery of a parking lot formed of asphalt pavement atop a base layer which overlies a crushed stone base. The setback distance of each course of base blocks relative to the immediately preceding course of base blocks is the same as the setback distance of each course of wall blocks relative to the immediately preceding course of wall blocks. By such a construction, the two back-to-back walls converge upwardly towards one another and are capped at the top by the cap blocks 55. Due to the equal setback distance of the blocks of each course relative to the blocks of the immediately preceding course, the face of the parapet wall section appears to be a continuation of the face of the retaining wall section. As described below with reference to FIG. 14, the split panels provided on the front faces of the base blocks and wall blocks and the simulated dress joints between the split panels create a wall face in which the likelihood of having two repeating vertical joints and in two adjacent courses is greatly diminished.

FIG. 14 is another example of a double-wall structure in which the two back-to-back walls constitute a parapet wall with one of the walls erected atop a retaining wall. In this example, the retaining wall comprises three courses of base blocks 102A,102B,102C atop of which is erected one wall comprised of successive courses of wall blocks 2A,2B,2C, 2D,2E. The other wall is likewise comprised of successive courses of wall blocks 2A,2B,2C,2D,2E erected atop a single course of base blocks 102A. The tops of the two uppermost courses of wall blocks 2E are capped by cap blocks 55. Though not illustrated, the internal cavities of the blocks and the space between the backs of the two walls of blocks are filled with filler, such as crushed stone, to lock the blocks together structurally. The blocks of each succeeding course are interconnected to the blocks of the immediately preceding course by the protuberance-and-groove connection, and the cap blocks 55 are likewise connected to the wall blocks 2E by a protuberance-and-groove connection though the cap blocks may also be set in mortar or otherwise bonded to the wall blocks 2E.

The setback distance is preselected by the protuberance-and-groove connection between abutting blocks to fully expose the upper curved edges 23*a*,24*a* of the wall blocks and the upper curved edges 123*a*,124*a* of the base blocks so that the vertical and horizontal joints of all the blocks have the same appearance. Due to the flat bottom edges 23*b* and 24*b* of the panels 23 and 24 of the wall blocks and the flat bottom edges 123*b* and 124*b* of the panels 123 and 124 of the base blocks, all the panels of all the blocks are bordered by the curved, rounded edges of the blocks, which presents an aesthetically pleasing and attractive appearance. The simulated dress joints created by the curved edges 25*a* of the grooves 25 of the wall blocks and the curved edges 125*a* of the grooves 125 of the base blocks are virtually indistinguishable from the actual joints between abutting blocks to an observer. The use of the split-panel technique in this manner results in a double-wall structure having wall faces in which the vertical joints appear to be more random than would otherwise be the case. This is also advantageous during installation of the double-wall structure since the likelihood of having two repeating vertical joints in two abutting courses is greatly diminished thereby obviating the need of the installer having to slow down the installation to cut blocks to eliminate vertical alignment of joints.

A fence wall, parapet wall or other wall comprised of a double-wall structure according to the present invention can easily be installed by a single landscape contractor and therefore is more economical to build as compared to prior art walls constructed for the same purpose. The protuberance-and-groove connection between the blocks in abutting courses and the loose stone filled in the internal cavities of the blocks and in the space between the backs of the two walls effectively locks the blocks together structurally and provide the mass required to resist both high wind loads and the accidental impact of motor vehicles. The fence wall, parapet wall or other wall may be used as a replacement for handrails and exhibits an aesthetically pleasing appearance whether used in a commercial or residential setting.

It will be appreciate by those skilled in the art that obvious changes can be made to the examples and embodiments described in the foregoing description without departing from the broad inventive concept thereof. It is understood, therefore, that this disclosure is not limited to the particular examples and embodiments disclosed, but it intended to cover all obvious modifications thereof which are within the scope of the disclosure as defined by the appended claims.

What is claimed is:

1. A double-wall structure comprising: two back-to-back wall sections each comprising successive courses of wall blocks dry-stacked one atop another with each succeeding course set back relative to the immediately preceding course so that the two back-to-back wall sections converge upwardly towards one another; and a foundation comprising one or more courses of base blocks beneath each wall section of wall blocks and on which the wall sections of wall blocks are erected, the base blocks having a greater front-to-rear depth than that of the wall blocks; wherein the lowermost course of wall blocks in each wall section is set back relative to the uppermost course of base blocks on which the lowermost course of wall blocks is erected, and wherein the setback distance between successive courses of wall blocks is the same, and the setback distance between the lowermost course of wall blocks and the uppermost course of base blocks is the same as that between successive courses of wall blocks.

2. A double-wall structure according to claim 1; wherein the foundation beneath at least one of the wall sections of wall blocks comprises successive courses of base blocks stacked one atop another with each succeeding course set back relative to the immediately preceding course.

3. A double-wall structure according to claim 2; wherein the foundation constitutes a retaining wall and the double-wall structure erected on the foundation constitutes a parapet wall.

4. A double-wall structure according to claim 3; further including cap blocks that cap the top of the parapet wall.

5. A double-wall structure according to claim 2; wherein the setback distance between successive courses of base blocks is the same.

6. A double-wall structure according to claim 2; wherein the setback distance between successive courses of base blocks is the same as that between successive courses of wall blocks.

7. A double-wall structure according to claim 1; wherein the uppermost courses of base blocks, on which the lowermost courses of wall blocks are erected, are situated at or below ground level, and the double-wall structure erected on the uppermost courses of base blocks constitutes a fence wall.

8. A double-wall structure according to claim 7; further including cap blocks that cap the top of the fence wall.

9. A double-wall structure according to claim 1; wherein the space between the back-to-back wall sections is substantially or completely filled with loose stone.

10. A double-wall structure according to claim 1; wherein the base blocks in each course of base blocks all have the same size.

11. A double-wall structure according to claim 1; wherein the top-to-bottom height of the wall blocks is the same as that of the base blocks.

12. A double-wall structure according to claim 11; wherein the maximum side-to-side width of the wall blocks is the same as that of the base blocks.

13. A double-wall structure according to claim 1; wherein the maximum side-to-side width of the wall blocks is the same as that of the base blocks.

14. A double-wall structure according to claim 1; wherein the wall blocks and the base blocks are molded concrete blocks.

15. A double-wall structure according to claim 1; wherein each of the wall blocks and base blocks has spaced-apart front and rear sections interconnected by two laterally spaced-apart side sections that jointly define a through-cavity that extends through the block from a top face thereof to a bottom face thereof, and wherein each of the wall blocks and base blocks has protuberances protruding upwardly from the top face of the front section frontward of the through-cavity and a groove provided in the bottom face of the front section frontward of the through-cavity, the groove being located and dimensioned relative to the protuberances so that the grooves in the blocks in each succeeding course engage with the protuberances of the blocks in the immediately preceding course with each succeeding course set back relative to the immediately preceding course.

16. A double-wall structure according to claim 15; wherein the groove in each block has spaced-apart front and rear walls and is located and dimensioned relative to the protuberances so that one but not both of the front and rear walls of the grooves in the blocks in each succeeding course engages with the protuberances of the blocks in the immediately preceding course.

17. A double-wall structure according to claim 15; wherein the protuberances of each wall block and base block have straight rear sides all lying along a common straight line.

18. A double-wall structure according to claim 15; wherein through-cavities of wall blocks in each succeeding course partly overlap through-cavities of wall blocks in the immediately preceding course; and further comprising a filler substantially or completely filling the overlapping through-cavities.

19. A double-wall structure according to claim 18; wherein the filler comprises loose stone.

20. A double-wall structure according to claim 18; wherein the wall blocks in each succeeding course are staggered relative to the wall blocks in the immediately preceding course.

21. A double-wall structure according to claim 15; further including cap blocks that cap the tops of wall blocks in the uppermost courses of the two back-to-back wall sections.

22. A double-wall structure according to claim 21; wherein each cap block caps at least part of the tops of wall blocks of both wall sections.

23. A double-wall structure according to claim 22; wherein the cap blocks have grooves that engage with the protuberances protruding upwardly from the top faces of the uppermost courses of wall blocks.

24. A double-wall structure according to claim 1; wherein the wall blocks of each wall section have a textured front surface that faces outwardly of the double-wall structure.

25. A double-wall structure according to claim 1; wherein the wall blocks have textured front surfaces that are divided into panels of different sizes.

* * * * *